US006658898B2

(12) United States Patent
Okamoto

(10) Patent No.: US 6,658,898 B2
(45) Date of Patent: Dec. 9, 2003

(54) BINDING-OFF PROCESS, BOUND OFF FABRIC, AND CAD SYSTEM FOR BINDING-OFF PROCESS

(75) Inventor: Kazuyoshi Okamoto, Gose (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/130,286

(22) PCT Filed: Dec. 14, 2000

(86) PCT No.: PCT/JP00/08878

§ 371 (c)(1),
(2), (4) Date: May 29, 2002

(87) PCT Pub. No.: WO01/48286

PCT Pub. Date: Jul. 5, 2001

(65) Prior Publication Data

US 2002/0189299 A1 Dec. 19, 2002

(30) Foreign Application Priority Data

Dec. 17, 1999 (JP) ..... 11-358759

(51) Int. Cl.[7] ..... D04B 7/00
(52) U.S. Cl. ..... 66/64; 66/172 R; 700/141
(58) Field of Search ..... 66/64, 175, 176, 66/172 R, 70, 169 A, 171, 170, 169 R, 69, 75.2; 700/141, 182, 130, 171, 132

(56) References Cited

U.S. PATENT DOCUMENTS 5,456,096 A * 10/1995 Mitsumoto et al. ..... 66/69
5,669,244 A * 9/1997 Okuno ..... 66/64
5,836,177 A * 11/1998 Okuno et al. ..... 66/64
6,070,438 A * 6/2000 Okuno et al. ..... 66/172 R
6,119,050 A * 9/2000 Okuno et al. ..... 66/64

FOREIGN PATENT DOCUMENTS

| | | |
|---|---|---|
| EP | 468687 | 1/1992 |
| JP | 8-337946 | 12/1996 |
| JP | 9-241950 | 9/1997 |

* cited by examiner

*Primary Examiner*—Danny Worrell
(74) *Attorney, Agent, or Firm*—Rothwell, Figg, Ernst & Manbeck

(57) ABSTRACT

At least three bind-off courses are formed starting at not less than three loops, i.e., loops of the first and second knitted fabrics at side ends thereof on the side on which the knitting of a tubular fabric is finished in the region of the binding-off process, and a loop adjoining to the loop of at least either of the first and second knitted fabrics at the side end. The loop of the bind-off course formed is laid over the loop of the last course of the opposite knitted fabric in such a manner that while being formed, the respective bind-off courses can be allowed to extend in zigzag from the first knitted fabric to the second knitted fabric and vice versa, ranging over the region of the binding-off process, to be crossed with each other. As a result of this knitting, no undesirable gap is produced between the joined knitted fabrics and also an undesirable stretch of the fabric at the joints is suppressed.

5 Claims, 8 Drawing Sheets

BINDING-OFF PROCESS, BOUND OFF FABRIC, AND CAD SYSTEM FOR BINDING-OFF PROCESS

TECHNICAL FIELD

The present invention relates to a binding-off process to prevent loosening of stitches by joining the stitches of two knitted fabrics knitted in overlapping relation in back and front to each other by using a flat knitting machine comprising at least a pair of front and back needle beds having a number of knitting needles fitted in needle grooves. The present invention also relates to a knitted fabric thus bound off and to a CAD system storing therein the data of the binding-off process of the invention.

BACKGROUND ART

A binding-off process for preventing loosening of stitches in the last course of a fabric knitted in a flat knitting machine is known. In the binding-off process, the knitting process that a loop in the last course of the knitted fabric is laid over the next to form a double loop and then a bind-off loop is formed at the double loop is repeated from one end of the fabric to the other end thereof, whereby the loops of the last course of the knitted fabric are cleared in sequence from the needles. When this knitting process is used for loops in the last course of a tubular fabric whose front and back fabrics are knitted in overlapping relation in back and front so that the loops are bound off on the both front and back needle beds, the both fabrics are joined to each other on the side on which the knitting is finished. For example, when this binding-off process is used for the joining of front and back bodies of a sweater along a shoulder line, the need of a sewing process after the knitting can be eliminated.

The applicant previously made the proposals for the binding-off process of a tubular knitted fabric in Japanese Laid-open (Unexamined) Patent Publications No. Hei 8 (1996)-337946 and No. Hei 9 (1997)-241950. Japanese Laid-open (Unexamined) Patent Publication No. Hei 8 (1996)-337946 discloses the binding-off process wherein after once a loop of a front knitted fabric and a loop of a back knitted fabric, placed opposite, are mutually transferred to the needles on the opposite needle beds, the loop of the back knitted fabric is laid over the loop of the front knitted fabric. Then, a bind-off loop continuous with the double loop thus formed is formed. This knitting process is repeated for the binding-off process of the front and back knitted fabrics. In this binding-off process, only a single course of bind-off loops is formed along the joints of the front and back knitted fabrics. It is to be noted that the terminology of "the bind-off course" occurring in this specification is intended to mean a chain stitch of the bind-off loops formed in the binding-off process.

Japanese Laid-open (Unexamined) Patent Publication No. Hei 9 (1997)-241950 discloses that after the bind-off loops are formed in each of the front knitted fabric and the back knitted fabric, the bind-off loops thus formed are transferred to transfer empty needles on the opposite needle beds or transfer jacks and the like on upper auxiliary needle beds, whereby the bind-off loops are crossed with each other over a cross-over yarn and, thereafter, the bind-off loop formed in the front knitted fabric is laid over the loop at the inside of the front knitted fabric and also the bind-off loop formed in the back knitted fabric is laid over the loop at the inside of the back knitted fabric in the same manner. This knitting process is repeated to interweave the bind-off loops with each other, whereby the knitted fabrics are joined to each other. In this binding-off process, two bind-off courses are formed along the joints of the front and back knitted fabrics. Accordingly, the knitted fabric bound off in this binding-off process can be prevented from stringing out at the joints, as compared with the knitted fabric bound off in the binding-off process disclosed by Japanese Laid-open (Unexamined) Patent Publications No. Hei 8 (1996)-337946.

DISCLOSURE OF THE INVENTION

For providing further improvements, the present invention provides a binding-off process, which is performed by using a flat knitting machine comprising at least a pair of first and second needle beds, which have a number of needles, respectively, and are placed opposite in front and back; between which a needle bed gap is defined; and at least either of which is movable slidably transversely, and at least one yarn feeder for feeding a yarn to the needles of the first needle bed and the second needle bed and in which the knitting that a bind-off loop formed continuously with a loop in the last course of a tubular fabric comprising a first knitted fabric and a second knitted fabric is laid over a loop adjoining to the bind-off loop formed continuously with the loop in the last course of the fabric, to form a bind-off loop of the next course is repeated from one end of a region of the binding-off process toward the other end, to join the first and second knitted fabrics to each other on the side on which the knitting is finished, the binding-off process comprising:

1) the process that at least three bind-off courses are formed starting at not less than three loops, i.e., loops of the first and second knitted fabrics at side ends thereof in the region of the binding-off process, and a loop adjoining to the loop of at least either of the first and second knitted fabrics at the side end, and 2) the process that the bind-off loop formed is laid over the loop of the last course of the opposite knitted fabric in such a manner that while being formed, the respective bind-off courses can be allowed to extend in zigzag from the first knitted fabric to the second knitted fabric and vice versa, ranging over the region of the binding-off process, to be crossed with each other.

In the binding-off process, the respective bind-off courses are formed in the process order:

1) that the bind-off loops are formed at the loops of the first and second knitted fabrics at their respective side ends in the region of the binding-off process;

2) that the bind-off loops formed in the process 1 are each laid over the loop in the last course of the opposite knitted fabric;

3) that the bind-off loop is formed at the loop adjoining to the loop of at least either of the first and second knitted fabrics at the side end; and 4) that the bind-off loops formed in the process 3 are each laid over the loop in the last course of the opposite knitted fabric.

In the binding-off process, four bind-off courses may be formed starting at loops of the first and second knitted fabrics at side ends thereof in the region of the binding-off process, and loops adjoining to those loops of the first and second knitted fabrics at the side ends.

According to the present invention, at least three bind-off courses are formed starting at not less than three loops, i.e., loops of the first and second knitted fabrics at side ends thereof on the side on which the knitting of a tubular fabric is finished in the region of the binding-off process, and a loop adjoining to the loop of at least either of the first and second knitted fabrics at the side end, and the loop of the bind-off course formed is laid over the loop of the last course of the opposite knitted fabric in such a manner that while being formed, the respective bind-off courses can be allowed to extend in zigzag from the first knitted fabric to the second knitted fabric and vice versa, ranging over the region of the binding-off process, to be crossed with each other. This allows the bind-off courses to be densely weaved between the first and second knitted fabrics so as to close a gap therebetween and prevents an undesirable stretch of the fabric at the joints.

Also, the present invention provides a knitted fabric bound off in the binding-off process wherein a bind-off loop formed continuously with a loop in the last course of each of first and second knitted fabrics formed into a tubular fabric is laid over an adjoining loop in the last course to form a double loop, so that the bind-off loop formed continuously with the double loop forms the bind-off course extending continuously from one end of a region of the binding-off process toward the other end to join the first and second knitted fabric to each other, wherein at least three bind-off courses are formed starting at not less than three loops, i.e., loops of the first and second knitted fabrics at side ends thereof in the region of the binding-off process, and a loop adjoining to the loop of at least either of the first and second knitted fabrics at the side end, and the loops of the respective bind-off courses are each laid over the loop of the last course of the opposite knitted fabric in such a manner as to extend in zigzag from the second knitted fabric to the first knitted fabric and vice versa, ranging over the region of the binding-off process, so as to be crossed with each other.

Further, the present invention provides a CAD system used for a binding-off process which is performed by using a flat knitting machine comprising at least a pair of first and second needle beds, which have a number of needles, respectively, and are placed opposite in front and back; between which a needle bed gap is defined; and at least either of which is movable slidably transversely, and at least one yarn feeder for feeding a yarn to the needles of the first needle bed and the second needle bed, and in which the knitting that a bind-off loop formed continuously with a loop in the last course of a tubular fabric comprising first and second knitted fabrics is laid over a loop adjoining to the bind-off loop formed continuously with the loop in the last course of the fabric, to form a bind-off loop of the next course is repeated from one end of a region of the binding-off process toward the other end, to join the first and second knitted fabrics to each other on the side on which the knitting is finished, the CAD system being designed to give knitting commands for:

1) the process of at least three bind-off courses being formed starting at not less than three loops, i.e., loops of the first and second knitted fabrics at side ends thereof in the region of the binding-off process and a loop adjoining to the loop of at least either of the first and second knitted fabrics at the side end, and 2) the process that the loop of the bind-off course formed is laid over the loop of the last course of the opposite knitted fabric in such a manner that while being formed, the respective bind-off courses can be allowed to extend in zigzag from the first knitted fabric to the second knitted fabric and vice versa, ranging over the region of the binding-off process, to be crossed with each other.

BEST MODE FOR CARRYING OUT THE INVENTION

An example of the present invention will be described below with reference to the accompanying drawings.

Figure 2:
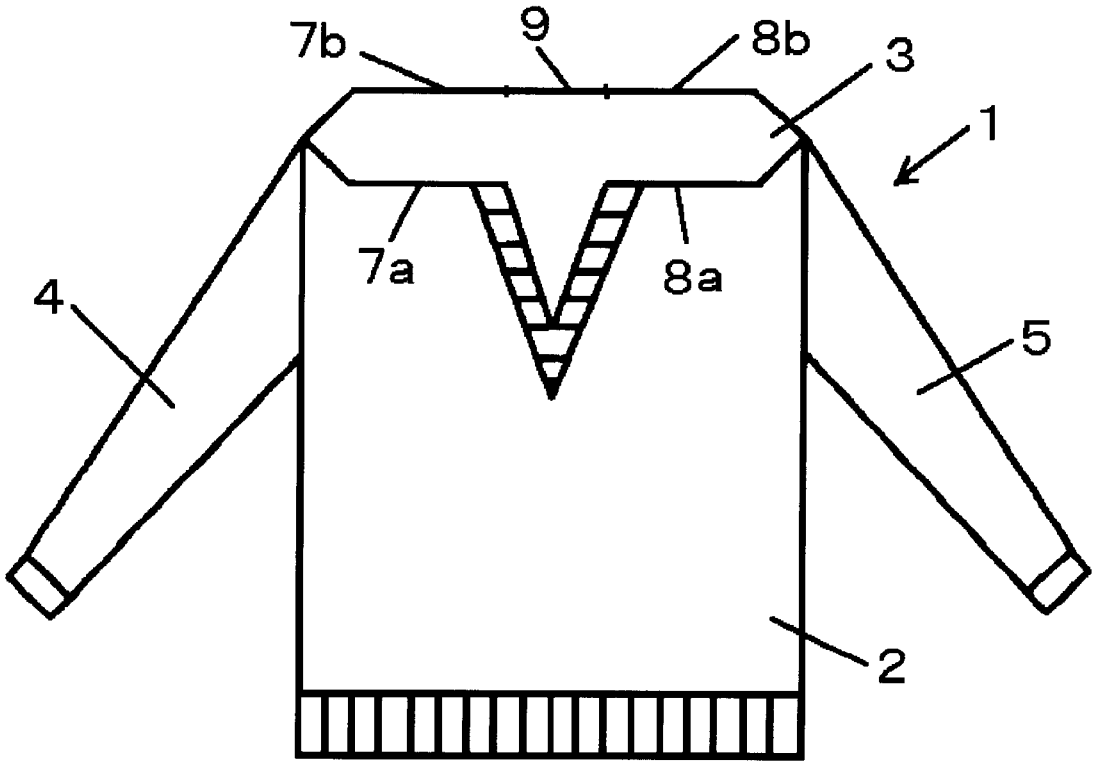
FIG. 2 shows the state of the sweater of FIG. 1 before starting to undergoing the binding-off process.

Bodies 2, 3 and right and left sleeves 4, 5 of a sweater 1 are knitted in the form of a tubular knitted fabric form, respectively, by using a number of needles in a plurality of regions on the needle beds. Thereafter, the right and left sleeves 4, 5 are transferred to and connected to the bodies 2, 3. At the point of time when the connection between the right and left sleeves 4, 5 and the bodies 2, 3 has been completed, the front body 2 and the back body 3 are connected to each other at both ends thereof, but are not yet connected to each other at the shoulder, as shown in FIG. 2. Stitches of a right front shoulder portion 7*a* and stitches of a left front shoulder portion 8*a* are held on the needles of the front needle bed across a nape opening 6. Stitches of a right back shoulder portion 7*b* and stitches of a left back shoulder portion 8*b* are held on the needles of the back needle bed across a back neck portion 9 corresponding to the nape opening 6. The knitting so far is known from Japanese Patent Publication No. Hei 4 (1992)-15301.

The right front shoulder portion 7*a* and the right back shoulder portion 7*b*, and the left front shoulder portion 8*a* and the left back shoulder portion 8*b* are connected to each other at the shoulder portions on the side on which the knitting is finished, so as to prevent loosening of stitches thereat. The right shoulder portion 7 and the left shoulder portion 8 are symmetrically knitted. For the sake of avoidance of repetition, description on the binding-off of the left shoulder portion 8 only will be given below. It is also to be noted that in the following, the left front shoulder portion 8*a* is described as a front knitted fabric 10*a*, and the left back shoulder portion 8*b* is described as a back knitted fabric 10*b*. For convenience of explanation, a fewer number of needles than the actual number of needles is illustrated herein. The present invention is practically used with a flat knitting machine comprising at least two front and back needle beds, such as two or four needle beds, which are placed opposite in front and back and at least either of which is movable sidably transversely. In the illustrated embodiment, a two-needle-bed flat knitting machine with only the back needle bed movable sidably transversely is used.

Figure 1:
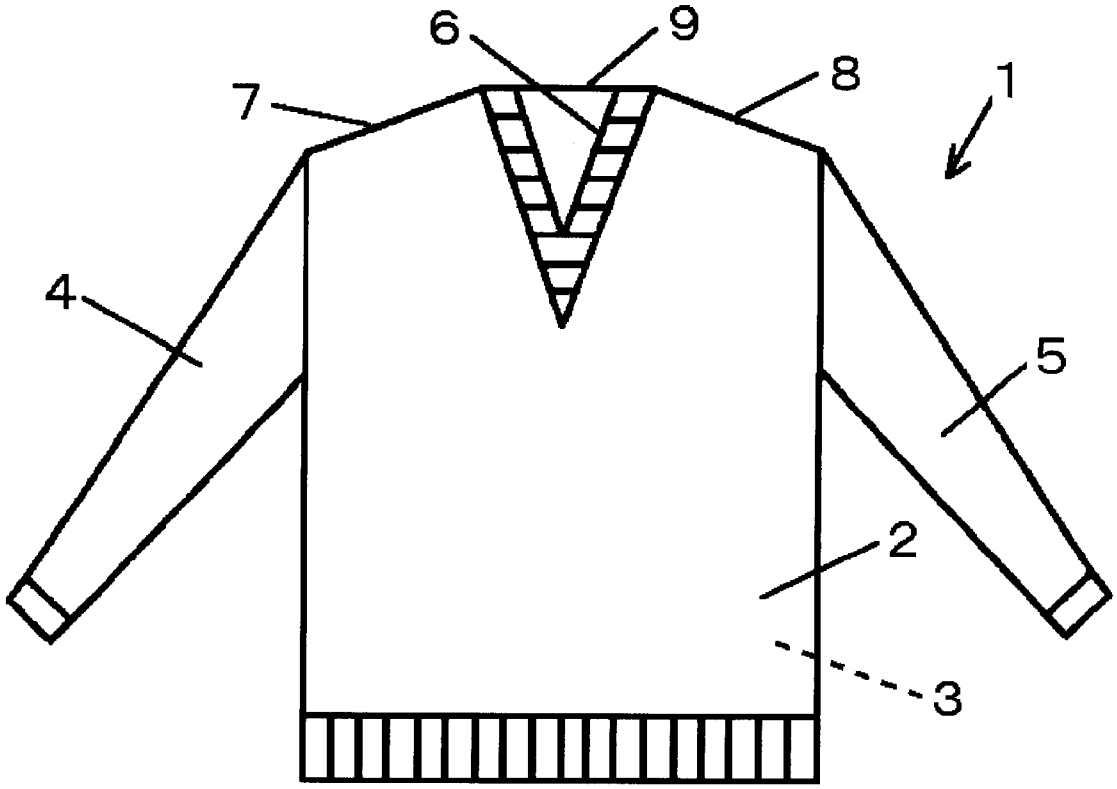
FIG. 1 shows a sweater bound off along the shoulder line in the bonding-off process of the invention.
Figure 3:
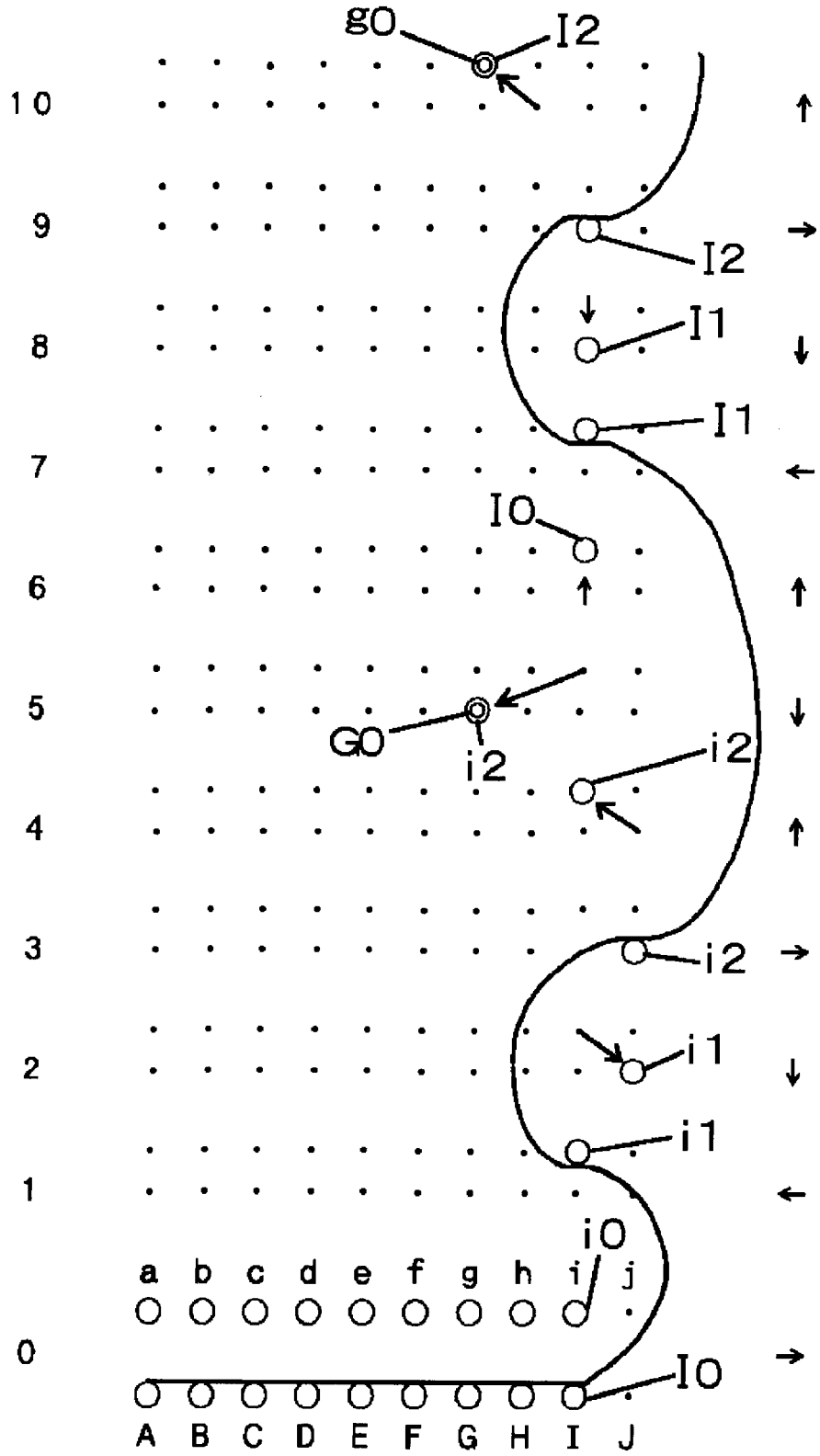
FIG. 3 shows a knitting course diagram of an embodiment of the invention.
Figure 4:
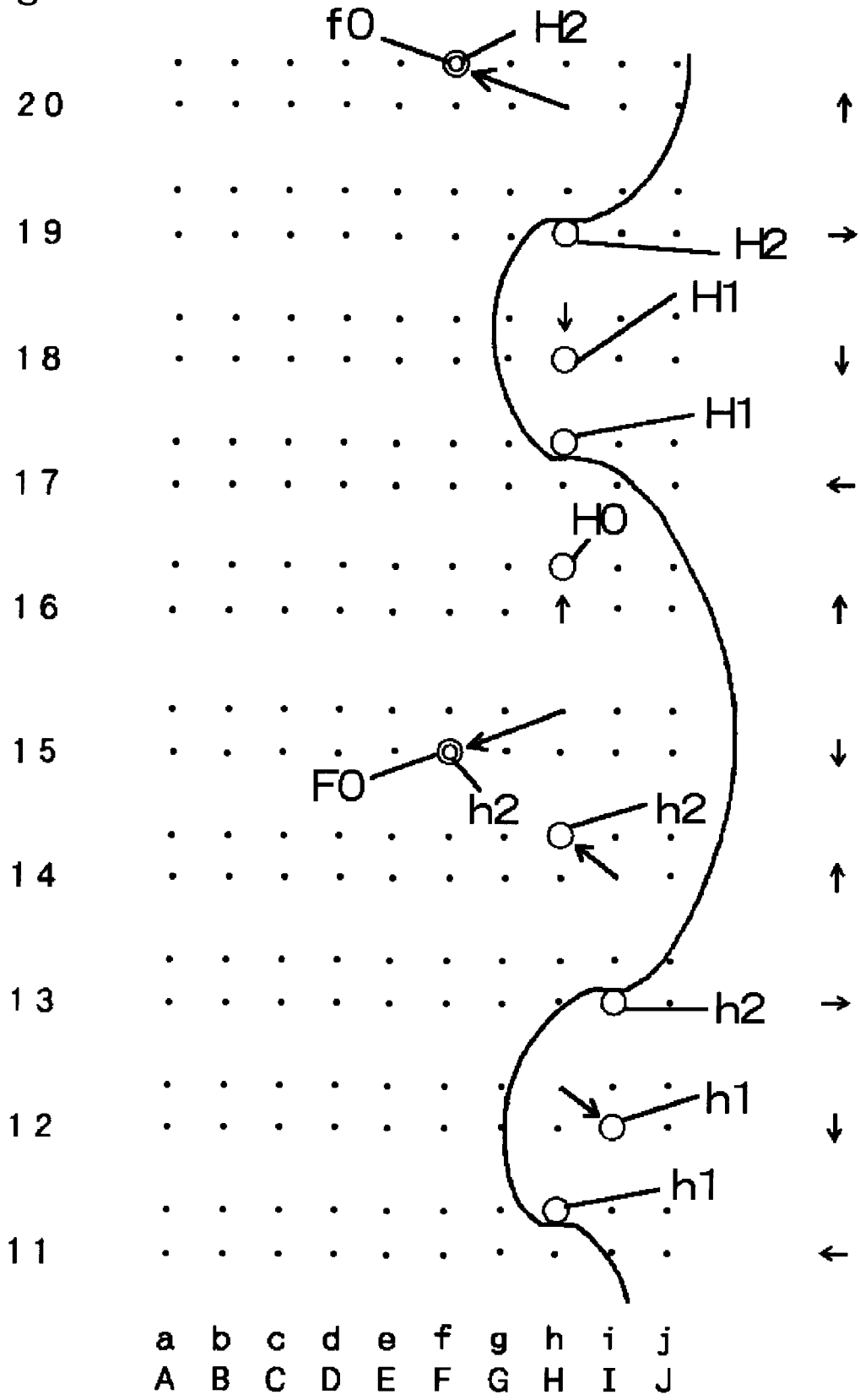
FIG. 4 shows a knitting course diagram of the embodiment of the invention.
Figure 5:
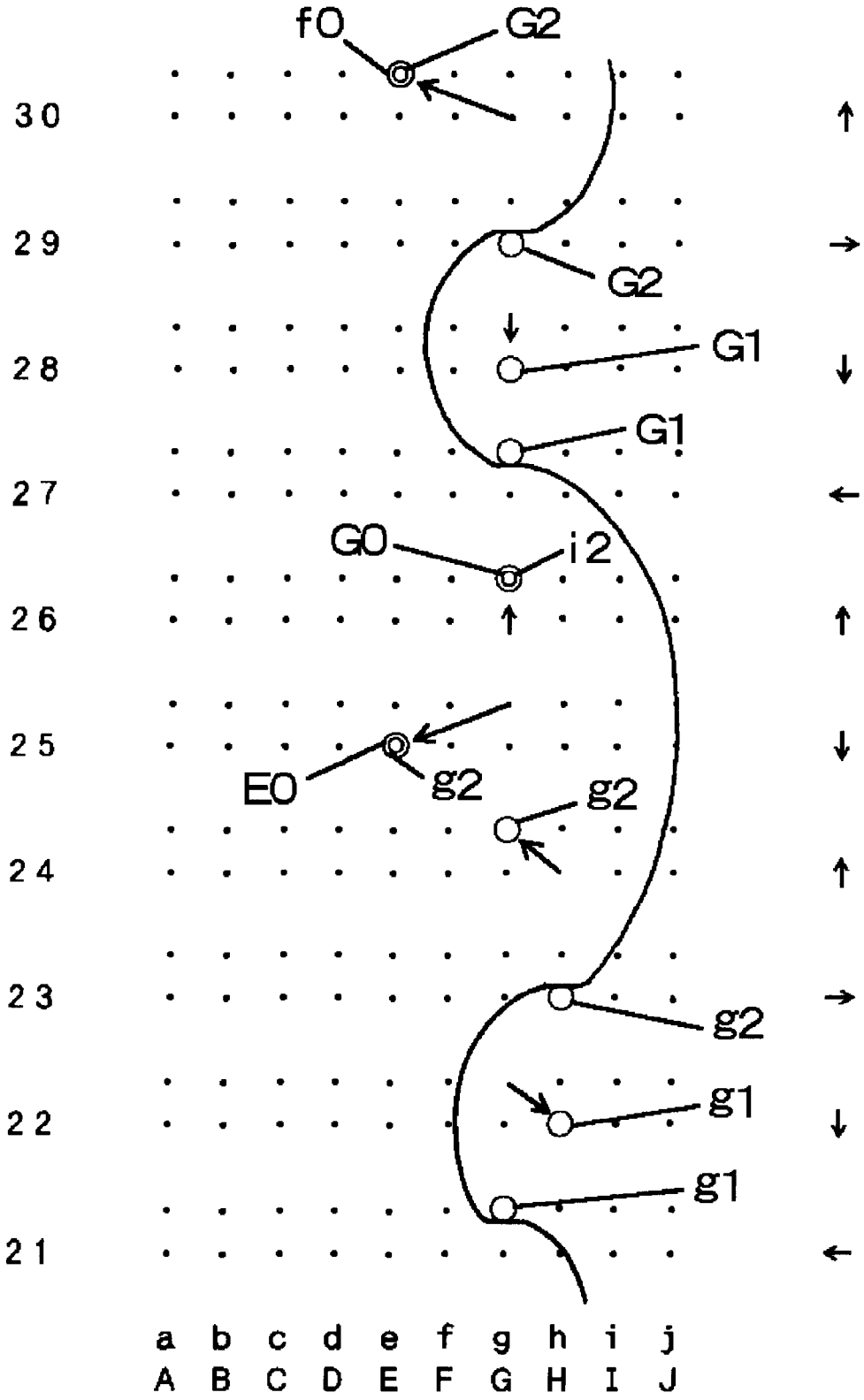
FIG. 5 shows a knitting course diagram of the embodiment of the invention.

The embodiment is described with reference to FIG. 3 to FIG. 8. In FIGS. 3–5, the numerals at the left side indicate the serial number of the courses; the vertical arrows indicate the direction for the loops to be transferred; and the horizontal arrows indicate the knitting direction. The course 0 of FIG. 3 shows the state before starting the binding-off process. The front knitted fabric 10*a* is held on the needles A-I of the front needle bed, and the back knitted fabric 10*b* is held on the needles a-i of the back needle bed. As a result of the knitting of the previous course, a yarn feeder is shifted rightwards over a guide rail (not shown) arranged in the longitudinal direction of the needle bed along a needle bed gap between the front and back needle beds, to feed a yarn to the needles A-I of the front needle bed, for the knitting, and is in a right end of a binding-off process region. The front knitted fabric 10*a* and the back knitted fabric 10*b* are connected within the binding-off region ranging from the needles I, i at the right end to the needles A, a. In the following description, reference is given, for the convenience sake, to the knitting wherein the binding-off process is performed starting from the needle I of the front needle bed and the needle i of the back needle bed until the double loop of the loop of the last course of the knitted fabric and the bind-off loop is formed by the needle E of the front needle bed and the needle e of the back needle bed. The binding-off process is performed from the right side to the left side, as viewed in FIG. 1. In the following description, the proceeding direction of the binding-off process means that the binding-off process proceeds from the right side to the left side.

Also, in the following description, alphabetical letters represent which loop in the last course the loop is formed continuously with, and numeric characters represent what number of course from the last course of the knitted fabric the loop falls under. For example, the loops of the last course of the front knitted fabric 10*a* are represented as E0, F0, . . . ; the bind-off loops formed continuously with the loops of the last course are represented as E1, F1, . . . ; and further the bind-off loops of the next course are represented as E2, F2, . . . The loops of the last course of the back knitted fabric 10*b* are represented as e0, f0, . . . ; the bind-off loops formed continuously with the loops of the last course are represented as e1, f1, . . . ; and further the bind-off loops of the next course are represented as e2, f2, . . . Referring to FIG. 3, in the course 1, a yarn is fed to the needle i of the back needle bed by the yarn feeder to from a bind-off loop i1. In the course 2, the bind-off loop i1 is transferred to the needle J of the front needle bed. In the course 3, the yarn is fed to the needle J to form a bind-off loop i2. Then, in the course 4, the bind-off loop i2 is transferred to the needle i of the back needle bed. Further, in the course 5, it is transferred to the needle G of the front needle bed in the course 5, to lay it over the loop G0 of the last course of the front knitted fabric 10*a* held on the needle G. In the course 6, the loop I0 of the front knitted fabric 10*a* held on the needle I of the front needle bed is transferred to the needle i of the back needle bed. In the course 7, the yarn is fed to the needle i to form the bind-off loop I1. In the course 8, after the bind-off loop I1 is transferred to the needle I of the front needle bed, the yarn is fed to the needle I to form the bind-off loop I2. Then, in the course 10, the newly formed bind-off loop I2 is transferred to the needle g of the back needle bed to lay it over the loop g0 of the back knitted fabric 10*b*.

Referring now to FIG. 4, in the courses 11 to 20, the knitting shown in the courses 1 to 10 of FIG. 3 is repeated, with a group of target loops each shifted a stitch to a group of loops positioned forward with respect to the proceeding direction of the binding-off direction.

Specifically, in the course 11 of FIG. 4, the yarn is fed to the needle h of the back needle bed to form a bind-off loop h1. In the course 12, the bind-off loop h1 is transferred to the needle I of the front needle bed. In the course 13, the yarn is fed to the needle I to form a bind-off loop h2. Then, in the course 14, the bind-off loop h2 is transferred to the needle h of the back needle bed. In the course 15, it is further transferred to the needle F of the front needle bed to lay it over the loop F0 of the last course of the front knitted fabric 10*a*. In the course 16, the loop H0 of the front knitted fabric is transferred to the needle h of the back needle bed. In the course 17, the yarn is fed to the needle h to form a bind-off loop H1. In the course 18, the bind-off loop H1 is transferred to the front needle bed. In the course 19, the yarn is fed to the needle H to form a bind-off loop H2. Then, in the course 20, the bind-off loop H2 is transferred to the needle f of the back needle bed to lay it over the loop f0 of the last course of the back knitted fabric 10*b*.

Referring further to FIG. 5, in the course 21, the yarn is fed to the needle g of the back needle bed on which the double loop g0-I2 is held as a result of the knitting of the courses 1 to 10, to form a bind-off loop g1. As a result of this, the bind-off loop I2 formed continuously with the bind-off loop I1 is cleared from the needle and thus the number of stitches held on the needles reduces a stitch from the course 0. In the course 22, the newly formed bind-off loop g1 is transferred to the needle H of the front needle bed. In the course 23, the yarn is fed to the needle H of the front needle bed to form a bind-off loop g2. In the course 24, the bind-off loop g2 is transferred to the needle g of the back needle bed. Then, in the course 25, the bind-off loop g2 is transferred to the needle E of the front needle bed to lay it over the loop E0 of the last course of the front knitted fabric 10*a*. In the course 26, the double loop G0-i2 held on he needle G of the front needle bed is transferred to the needle g of the back needle bed. In the course 27, the yarn is fed to the needle g to form a bind-off loop G1. Then, in the course 28, the bind-off loop G1 is transferred to the front bed. Thereafter, in the course 29, the yarn is fed to the needle G of the front needle bed to form a bind-off loop G2. In the course 30, the bind-off loop G2 is transferred to the needle f of the back needle bed to lay it over the loop f0 of the back knitted fabric. Subsequently, the knitting shown in the courses 21 to 30 is repeated, while a group of target loops are each shifted a stitch to a group of loops positioned forward with respect to the proceeding direction of the binding-off direction, whereby the front knitted fabric 10*a* and the back knitted fabric 10*b*are joined.

Figure 6:
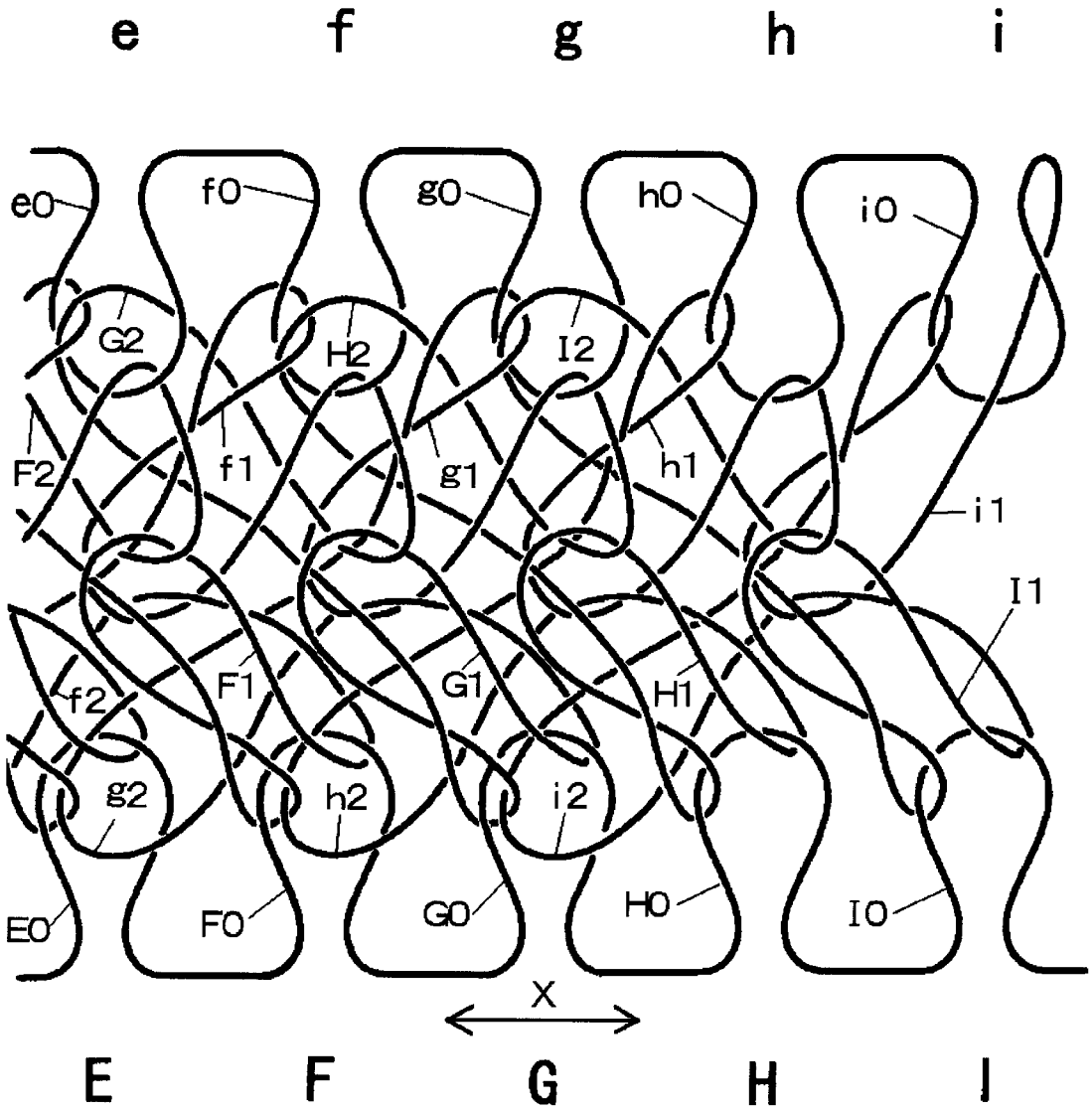
FIG. 6 shows a loop diagram of the knitted fabric that was bound off in the knitting of the embodiment of the invention.
Figure 7:
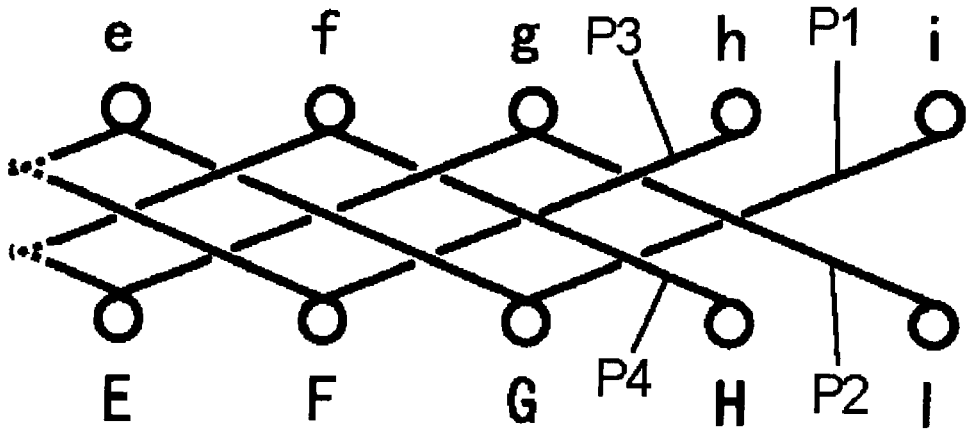
FIG. 7 shows the cross of the courses of bind-off loops of the embodiment of the invention.
Figure 8:
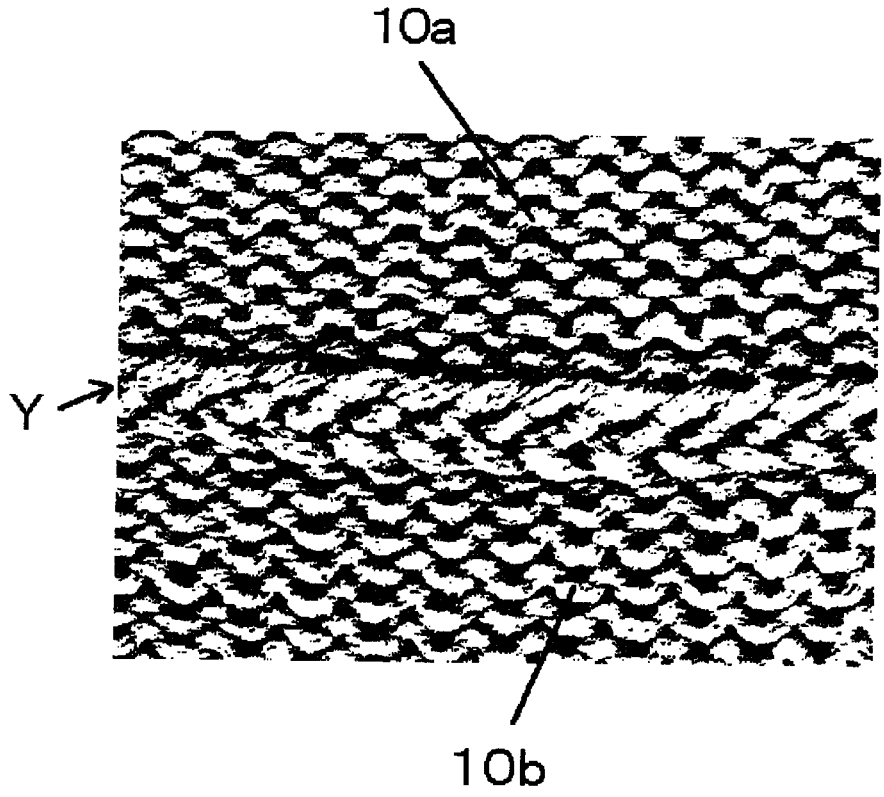
FIG. 8 shows the knitted fabric that was bound off in the knitting of the embodiment of the invention, when viewed from the inside thereof.

In the knitted fabric thus bound off in the binding-off process mentioned above, four bind-off courses, comprising a first bind-off course i1, i2, G1, G2, . . . (indicated by P1 in FIG. 7) which is formed starting at the loop i0 at a side end of the back knitted fabric 10*b*, a second bind-off course I1, I2, g1, g2, . . . (indicated by P2 in FIG. 7) which is formed starting at the loop I0 of the front knitted fabric 10*a*, a third bind-off course h1, h2, F1, F2, . . . (indicated by P3 in FIG. 7) which is formed starting at the loop h0 of the back knitted fabric 10*b*, and a fourth bind-off course H1, H2, f1, f2, . . . (indicated by P4 in FIG. 7) which is formed starting at the loop H0 of the front knitted fabric 10*a*, are allowed to extend in zigzag between the front knitted fabric 10*a* and the back knitted fabric 10*b*, ranging over the whole region of the binding-off process, as shown in FIGS. 6 to 8. Thus, the bind-off courses are densely weaved between the front knitted fabric 10*a* and the back knitted fabric 10*b*. As a result of this, a bind-off fabric with a gap between the front knitted fabric and the back knitted fabric closed is formed. Also, since the four bind-off courses are extended over the whole region of the binding-off process, an excessive stretch of the fabric in the widthwise direction of the knitted fabric indicated by the arrow X can be suppressed.

Figure 9:
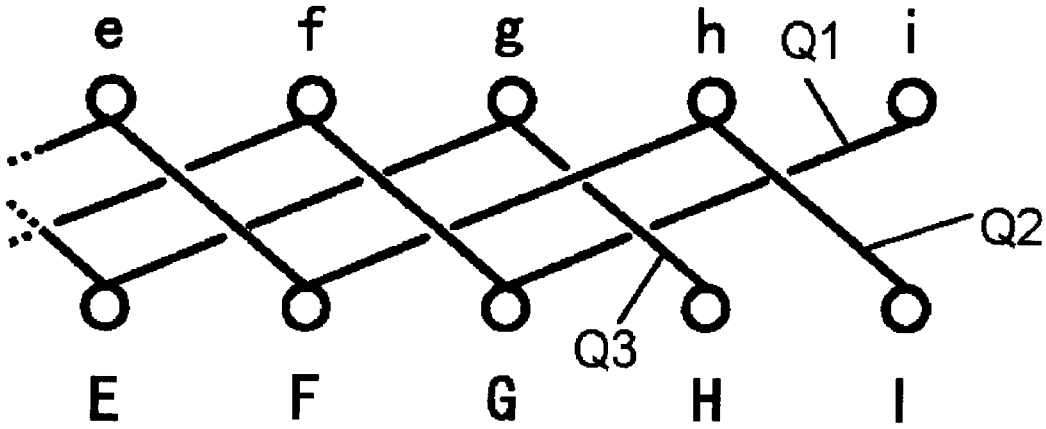
FIG. 9 shows the cross of the courses of bind-off loops in the knitting of another embodiment of the invention.

Although the embodiment wherein the four bind-off courses are formed from the four groups of loops has been described above, three bind-off courses Q1, Q2 and Q3 may be formed from three groups of loops, for the binding off process of the fabric, as shown in FIG. 9. Alternatively, four or more bind-off courses may be formed from four or more groups of loops. It is to be noted that selection may be freely made on which form the bind-off loops formed continuously with the front knitted fabric 10*a* and the back knitted fabric 10*b* should be taken, the front stitch or the back stitch, and on what number of courses should be formed. Although the embodiment wherein the bind-off loops are alternately formed in the front knitted fabric 10*a* and the back knitted fabric 10*b* has been described above, the order in which the bind-off loops are formed may be changed. Also, although the embodiment wherein the fabric is knitted with the front knitted fabric 10*a* and the back knitted fabric 10*b* formed to be continuous with each other at both ends thereof has been described above, the binding-off process of the present invention may be practically applied to the case where the front knitted fabric 10*a* and the back knitted fabric 10*b* are knitted as separate knitted fabrics, as is the case with the binding-off process for e.g. a vest shoulder.

The flat knitting machine is driven under control of a computer built in the flat knitting machine that reads and interprets the knitting command stored in a disc and the like to control the respective mechanisms of the flat knitting machine. The principal knitting processes including the bonding-off process are stored in the form of subroutines in a CAD system for designing a knitted fabric. This type of CAD system includes the computer and output equipment so that the knitting commands can be written on the disc and the like. The CAD system stores principal points, including the knitting points on tubular knitting, widening stitch or narrowing stitch, and binding off, in the form of subroutines. The subroutines associated with respective parts of the fabric designed by a user are properly combined with each other, so that the appropriate knitting commands are output. The knitting commands include the command for the flat knitting machine having the computer built-in to knit the fabric in accordance with the knitting commands. Thus, the flat knitting machine is driven under control of the built-in computer, while also the knitting commands stored in the disc and the like are read by the built-in computer and are interpreted by the CAD system, to reproduce a design picture of the fabric designed on the CAD system by the user.

Capabilities of Exploitation in Industry

According to the present invention, at least three bind-off courses, which are formed starting at not less than three loops, i.e., loops of the first and second knitted fabrics at side ends thereof in the region of the binding-off process, as well as a loop adjoining to the loop of at least either of the first and second knitted fabrics at the side end, are allowed to extend in zigzag from the first knitted fabric to the second knitted fabric and vice versa, ranging over the region of the binding-off process, and the loops of the bind-off courses are each laid over the loop of the last course of the opposite knitted fabric. Thus, the bind-off courses are densely weaved in the bind-off portion of the fabric. As a result of this, a bind-off fabric with a gap between the front knitted fabric and the back knitted fabric closed is formed and also a stretch of the fabric in the widthwise direction of the fabric is suppressed to provide a reinforced fabric.

What is claimed is:

1. A binding-off process, which is performed by using a flat knitting machine comprising at least a pair of first and second needle beds, which have a number of needles, respectively, and are placed opposite in front and back; between which a needle bed gap is defined; and at least either of which is movable slidably transversely, and at least one yarn feeder for feeding a yarn to the needles of the first needle bed and the second needle bed and in which the knitting that a bind-off loop formed continuously with a loop in the last course of a tubular fabric comprising a first knitted fabric and a second knitted fabric is laid over a loop adjoining to the bind-off loop formed continuously with the loop in the last course of the fabric, to form a bind-off loop of the next course is repeated from one end of a region of the binding-off process toward the other end, to join the first and second knitted fabrics to each other on the side on which the knitting is finished, the binding-off process comprising:

1) forming at least three bind-off courses starting at not less than three loops, including loops of the first and second knitted fabrics at side ends thereof in the region of the binding-off process, and also including a loop adjoining to the loop of at least either of the first and second knitted fabrics at the side end, and 2) laying the bind-off loop over the loop of the last course of the opposite knitted fabric in such a manner that while being formed, the respective bind-off courses can be allowed to extend in a zigzag pattern from the first knitted fabric to the second knitted fabric and vice versa, ranging over the region of the binding-off process, to be crossed with each other.

2. The binding-off process according to claim 1, wherein the respective bind-off courses are formed in the following order:

1) forming the bind-off loops at the loops of the first and second knitted fabrics at their respective side ends in the region of the binding-off process;

2) laying each of the bind-off loops formed in the process 1 over the loop in the last course of the opposite knitted fabric;

3) forming the bind-off loop at the loop adjoining to the loop of at least either of the first and second knitted fabrics at the side end; and 4) laying each of the bind-off loops formed in the process 3 over the loop in the last course of the opposite knitted fabric.

3. The binding-off process according to claim 1, wherein four bind-off courses are formed starting at loops of the first and second knitted fabrics at side ends thereof in the region of the binding-off process, and loops adjoining to those loops of the first and second knitted fabrics at the side ends.

4. A knitted fabric bound off in the binding-off process wherein a bind-off loop formed continuously with a loop in the last course of each of first and second knitted fabrics formed into a tubular fabric is laid over an adjoining loop in the last course to form a double loop so that the bind-off loop formed continuously with the double loop can form the bind off course extending continuously from one end of a region of the binding-off process toward the other end to join the first and second knitted fabric to each other, wherein at least three bind-off courses are formed starting at not less than three loops, including loops of the first and second knitted fabrics at side ends thereof in the region of the binding-off process, and further including a loop adjoining to the loop of at least either of the first and second knitted fabrics at the side end, and the loops of the respective bind-off courses are each laid over the loop of the last course of the opposite knitted fabric in such a manner as to extend in a zigzag pattern from the second knitted fabric to the first knitted fabric and vice versa, ranging over the region of the binding-off process, so as to be crossed with each other.

5. A CAD system used for a binding-off process which is performed by using a flat knitting machine comprising at least a pair of first and second needle beds, which have a number of needles, respectively, and are placed opposite in front and back; between which a needle bed gap is defined; and at least either of which is movable slidably transversely, and at least one yarn feeder for feeding a yarn to the needles of the first needle bed and the second needle bed, and in which the knitting that a bind-off loop formed continuously with a loop in the last course of a tubular fabric comprising first and second knitted fabrics is laid over a loop adjoining to the bind-off loop formed continuously with the loop in the last course of the fabric, to form a bind-off loop of the next course is repeated from one end of a region of the binding-off process toward the other end, to join the first and second knitted fabrics to each other on the side on which the knitting is finished, the CAD system being designed to give knitting commands for:

1) the process of at least three bind-off courses being formed starting at not less than three loops, including loops of the first and second knitted fabrics at side ends thereof in the region of the binding-off process and a loop adjoining to the loop of at least either of the first and second knitted fabrics at the side end, and 2) the process that the loop of the bind-off course formed is laid over the loop of the last course of the opposite knitted fabric in such a manner that while being formed, the respective bind-off courses can be allowed to extend in a zigzag pattern from the first knitted fabric to the second knitted fabric and vice versa, ranging over the region of the binding-off process, to be crossed with each other.

* * * * *